US009070240B2

(12) United States Patent
Stieber et al.

(10) Patent No.: US 9,070,240 B2
(45) Date of Patent: Jun. 30, 2015

(54) METHOD AND APPARATUS FOR OFFSORTING COINS IN A COIN HANDLING MACHINE

(71) Applicant: Talaris Inc., Watertown, WI (US)

(72) Inventors: Jon Stieber, Oconomowoc, WI (US); Myron Spoehr, Lake Mills, WI (US); Robert Gunst, Neosho, WI (US); Zachery Erb, Germantown, WI (US)

(73) Assignee: Talaris Inc., Watertown, WI (US)

( * ) Notice: Subject to any disclaimer, the term of this patent is extended or adjusted under 35 U.S.C. 154(b) by 0 days.

(21) Appl. No.: 13/822,364

(22) PCT Filed: Jan. 25, 2013

(86) PCT No.: PCT/US2013/023184

§ 371 (c)(1),
(2) Date: Mar. 12, 2013

(87) PCT Pub. No.: WO2013/112864

PCT Pub. Date: Aug. 1, 2013

(65) Prior Publication Data

US 2014/0187134 A1 Jul. 3, 2014

Related U.S. Application Data

(60) Provisional application No. 61/590,539, filed on Jan. 25, 2012.

(51) Int. Cl.

| | |
|---|---|
| ***G07D 3/06*** | (2006.01) |
| ***G07D 5/02*** | (2006.01) |
| ***G07D 3/14*** | (2006.01) |
| ***G07D 3/16*** | (2006.01) |

(52) U.S. Cl.
CPC .. *G07D 3/14* (2013.01); *G07D 5/02* (2013.01); *G07D 3/06* (2013.01); *G07D 3/16* (2013.01)

(58) Field of Classification Search
CPC ..... G07D 3/00; G07D 3/06; G07D 5/00; G07D 5/02
USPC ..... 453/3, 4, 6, 10, 12, 49, 57; 194/302, 194/346, 334, 335
See application file for complete search history.

(56) References Cited

U.S. PATENT DOCUMENTS

| | | | | |
|---|---|---|---|---|
| 4,650,057 | A | 3/1987 | Koester | |
| 5,429,550 | A | 7/1995 | Mazur et al. | |
| 5,992,602 | A * | 11/1999 | Zwieg et al. | 194/317 |
| 6,039,644 | A | 3/2000 | Geib et al. | |
| 7,419,059 | B2 * | 9/2008 | Christiansen et al. | 209/559 |
| 7,704,133 | B2 | 4/2010 | Adams et al. | |
| 7,743,902 | B2 | 6/2010 | Wendel et al. | |
| 8,684,159 | B2 * | 4/2014 | Blake | 194/216 |

FOREIGN PATENT DOCUMENTS

| | | | |
|---|---|---|---|
| WO | WO 99/33030 A1 * | 7/1999 | G07D 3/00 |

* cited by examiner

*Primary Examiner* — Mark Beauchaine
(74) *Attorney, Agent, or Firm* — Boyle Fredrickson, S.C.

(57) ABSTRACT

A coin sorter machine including an encoder and a sensor assembly more accurately determines the position of coins in a coin sorting path to facilitate coin sorting. The coin sorter uses a coin size attribute to more accurately calculate the timing of interactions between coins on the coin sorting path and one or more components of the coin sorter. One such component is a diverter configured to perform an offsorting operation.

20 Claims, 13 Drawing Sheets

METHOD AND APPARATUS FOR OFFSORTING COINS IN A COIN HANDLING MACHINE

CROSS REFERENCE TO RELATED APPLICATIONS

This application claims the benefit of U.S. Provisional Patent Application 61/590,539, filed Jan. 25, 2012, hereby incorporated by reference in its entirety.

FIELD OF THE INVENTION

The present application relates to coin processing equipment and, more particularly, to coin sorters.

BACKGROUND

Zweig et al., U.S. Pat. No. 5,992,602, assigned to the assignee herein, discloses a coin sorter having a circular sorting track with an outside reference edge. The coins are moved by a coin moving disk with fingers that press down on and push the coin along its path. An upstanding half shaft of semicircular cross section is disposed along the reference edge to allow coins to pass, and is rotated to urge a selected coin away from the rim to an offsort location inward of the reference edge. The offsorting is actuated by an induction coil located beneath the track in advance of the diverter mechanism, when the signals generated from that coin do not fall within a range of acceptable values.

In Brandle et al., U.S. Pat. No. 6,729,461, assigned to the assignee herein, an optical sensor is used to detect coins by denomination by measuring a size of each coin. Inductive sensors measure alloy characteristics. These measurements are used to detect invalid coins, which are then offsorted. The offsorting arrangement in Brandle contained a transition area for diverting the coin out of the coin track to an opening, which was similar to the arrangement in U.S. Pat. No. 5,992,602.

It is now desired to improve the speed and accuracy of the offsorting operation by actuating the diverter mechanism based on a more precise determination of the coin position in the coin path.

SUMMARY OF THE INVENTION

This invention concerns an improvement in coin sorter machines using an encoder to facilitate coin sorting. In particular, a coin sorter having an encoder is provided that uses a coin size attribute to more accurately calculate the timing of interactions between coins on a coin sorting path and one or more components of the coin sorter. One such component is a diverter configured to perform an offsorting operation.

More particularly, a coin handling machine having a queuing mechanism for feeding coins to a sorting mechanism includes a reference edge disposed along a sorting disk for coins moving along a coin sorting path, the sorting disk having at least one opening for receiving valid coins as the coins travel along the coin sorting path, a drive member adjacent to the sorting disk for control of coins as the coins are moved in a single layer and a single file along the reference edge, a diverter disposed along the reference edge, the diverter member being operable to project into the coin sorting path in advance of the sorting openings to move a coin selected for offsorting away from the reference edge and an offsort opening near the sorting path, the offsort opening being located between the diverter member and the at least one opening for receiving valid coins, spaced from the reference edge, and positioned in the coin sorting path to receive coins that have been moved laterally toward the offsort opening. The coin handling machine further includes a coin sensor station configured to sense at least a coin size attribute of each coin and an encoder providing an encoder count based on the rotation of the drive member, wherein the operation of the diverter is controlled based on at least the encoder count and the coin size attribute.

In another embodiment, the invention concerns a method of counting coins in a coin sorter before reaching an opening to at least one collection receptacle. The method includes driving a plurality coins along their outer edges against a coin track that is adjacent a reference edge with the coins extending outwardly over an inside edge of the coin track, calculating a coin travel speed along the coin track based on an encoder counter using a controller module receiving data from an encoder, sensing at least a coin size attribute of the coin at a sensor assembly on the coin track and counting the coin based on an interaction between the coin and one of a coin offsorting opening and a coin sorting opening based on the coin travel speed and the coin size attribute.

In another embodiment, the coin travel speed and the coin size attribute are used to determine a position of every coin on the coin sorting path after the sensor assembly. In another embodiment, the position determination includes a position determination of both leading and trailing edges of the coin and is used to calculate an interaction time for the coin and a diverter prior to counting the coin at the offsort opening. In yet another embodiment, the operation of a diverter is controlled based on at least a lag time associated with the diverter, the encoder count and the coin size attribute Other objects and advantages of the invention, besides those discussed above, will be apparent to those of ordinary skill in the art from the description of the preferred embodiments which follows. In the description, reference is made to the accompanying drawings, which form a part hereof, and which illustrate examples of the invention.

BRIEF DESCRIPTION OF THE DRAWINGS

Other features and advantages of the invention will become apparent to those skilled in the art upon review of the following detailed description, claims and drawings in which like numerals are used to designate like features.

DETAILED DESCRIPTION OF THE INVENTION

Figure 1:
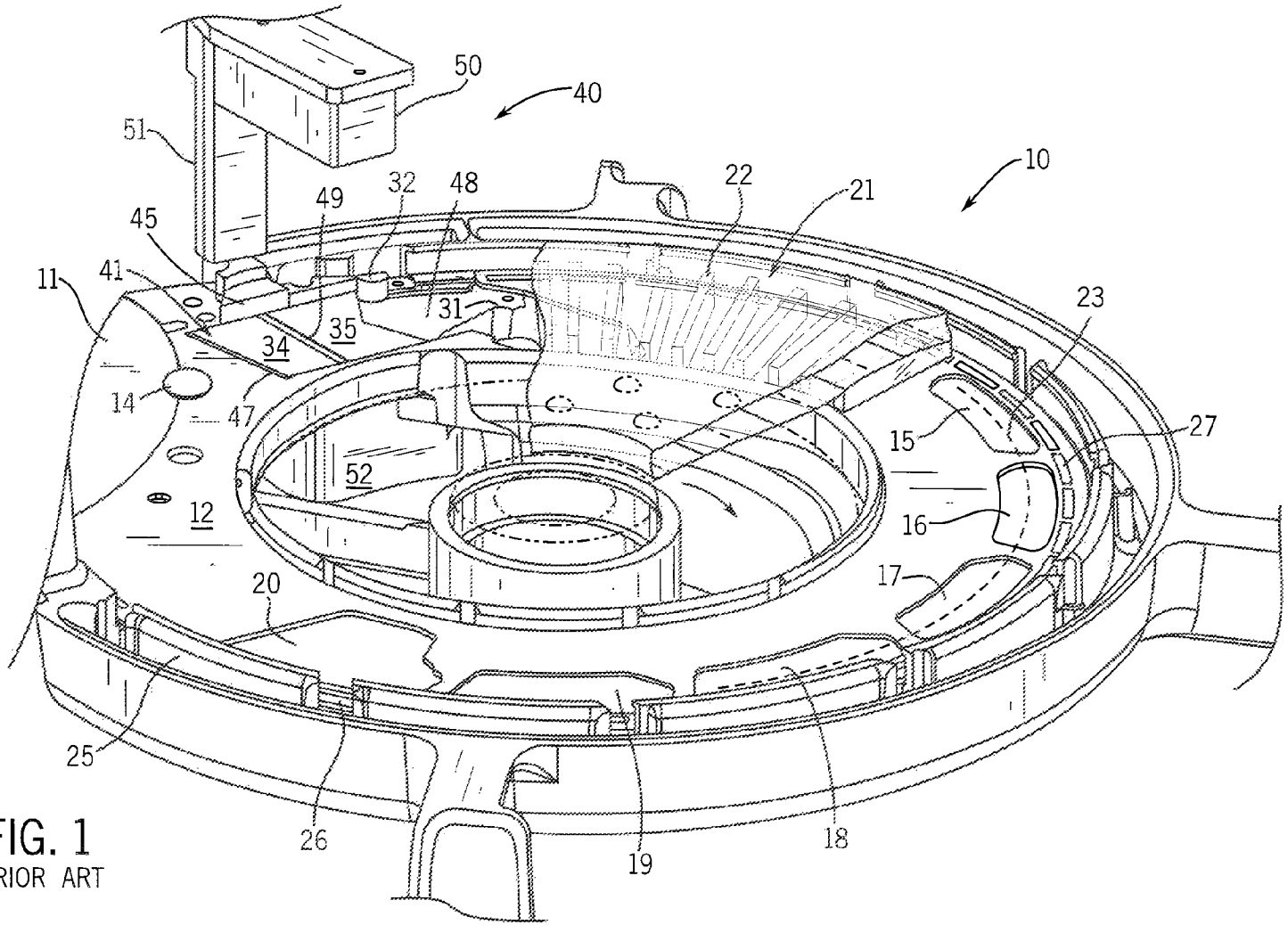
FIG. 1 PRIOR ART
FIG. 1 is a coin sorter known in the prior art, according to an exemplary embodiment.

Referring to FIG. 1, the coin handling machine 10 is a sorter of the type shown and described in Zwieg et al., U.S. Pat. No. 5,992,602, and previously offered under the trade designation, "Mach 12" and "Mach 6" by the assignee of the present invention. This type of sorter 10, sometimes referred to as a FIG. 8 type sorter, has two interrelated rotating disks, a first disk operating as a queuing disk 11 to separate the coins from an initial mass of coins and arrange them in a single file of coins 14 to be fed to a sorting disk assembly. The queuing disk 11 can be operated to feed coins up to a rate of 6000 coins per minute.

A sorting disk assembly has a lower sorter plate 12 with coin sensor station 40, an offsort opening 31 and a plurality of sorting openings 15, 16, 17, 18, 19 and 20. There may be as many as ten sorting openings, but only six are illustrated for this embodiment. The first five sorting openings are provided for handling U.S. denominations of penny, nickel, dime, quarter and dollar. From there, the coins are conveyed by shoots to collection receptacles as is well known in the art. The sixth sorting opening can be arranged to handle half dollar coins or used to offsort all coins not sorted through the first five apertures. In some embodiments as many as nine sizes can be accommodated. It should be noted that although only six sizes are shown, the sorter may be required to handle coins with twice the number of specifications. The machine can also be adapted to handle the Euro coin sets of the EU countries, as well as coin sets of other countries around the world.

As used herein, the term "apertures" shall refer to the specific sorting openings shown in the drawings. The term "sorting opening" shall be understood to not only include the apertures, but also sorting grooves, channels and exits seen in the prior art.

The sorting disk assembly also includes an upper, rotatable, coin moving member 21 with a plurality of fins 22 or fingers which push the coins along a coin sorting path 23 over the sorting openings 15, 16, 17, 18, 19 and 20. The coin moving member is a disk, which along with the fins 22, is made of a light transmissive material, such as acrylic. The coin driving disk may be clear or transparent, or it may be milky in color and translucent. In one embodiment, the coin driving disk may be an elastic disk drive, described in more detail in Adams et al., U.S. Pat. No. 8,267,755, issued Sep. 18, 2012.

The fins 22 of the prior art device shown in FIG. 1, also referred to as "webs," are described in more detail in Adams et al., U.S. Pat. No. 5,525,104, issued Jun. 11, 1996. Briefly, they are aligned along radii of the coin moving member 21, and have a length equal to about the last 10% of the radius from the center of the circular coin moving member 21.

An arcuate rail formed by a thin, flexible strip of metal (not shown) is installed in slots 27 to act as a reference edge against which the coins are aligned in a single file for movement along the coin sorting path 23. Although an arcuate reference edge is shown and described, it should be understood that the reference edge need not be arcuate. As the coins are moved clockwise along the coin sorting path 23 by the webs or fingers 22, the coins drop through the sorting openings 15, 16, 17, 18, 19 and 20 according to size, with the smallest size coin dropping through the first aperture 15. In the prior art system shown, as coins drop through the sorting openings, the coins may be sensed by optical sensors in the form of light emitting diodes (LEDs) 15*a*, 16*a*, 17*a*, 18*a*, 19*a* and 20*a* (not shown) and optical detectors 15*b*, 16*b*, 17*b*, 18*b*, 19*b* and 20*b* (not shown) in the form of phototransistors, one emitter and detector per aperture. The photo emitters 15*a*, 16*a*, 17*a*, 18*a*, 19*a* and 20*a* are mounted outside the barriers 25 seen in FIG. 1 and are aimed to transmit a beam through spaces 26 between the barriers 25 and an angle from a radius of the sorting plate 21, so as to direct a beam from one corner of each aperture 15, 16, 17, 18, 19 and 20 to an opposite corner where the optical detectors 15*b*, 16*b*, 17*b*, 18*b*, 19*b* and 20*b* are positioned.

As coins come into the sorting disk assembly 11, they first pass a coin sensor station 40 with both optical and inductive sensors for detecting invalid coins. Invalid coins are offsorted through an offsort opening 31 with the assistance of a solenoid-driven coin ejector mechanism 32 which directs according to an offsort transition area 48 and eventually to an offsort opening 31 is located inward of the coin track 23, the offsort operation being described in further detail below with reference to FIGS. 2-4.

The coin sensor station 40 used in the prior art includes a coin track insert 41 which is part of a coin sensor assembly housed in housing 52. This housing contains a circuit module (not shown) for processing signals from the sensors as more particularly described in U.S. Pat. No. 6,729,461.

Under the coin track are two inductive sensors. One sensor is for sensing the alloy content of the core of the coin, and another sensor is for sensing the alloy content of the surface of the coin. This is especially useful for coins of bimetal clad construction. The two inductive sensors are located on opposite sides of a light transmissive, sapphire window element 49.

The coin track insert 41 is disposed next to a curved rail (not shown) which along with edge sensor housing 45 forms a reference edge for guiding the coins along the coin track. An edge thickness/alloy inductive sensor is positioned in the edge sensor housing 45 so as not to physically project into the coin track. The coin track insert 41 has an edge 47 on one end facing toward the queuing disk, and a sloping surface 48 at an opposite end leading to the offsort opening 31.

A housing shroud 50 is positioned over the window element 49, and this shroud 50 contains an optical source provided by a staggered array of light emitting diodes (LED's) for beaming down on the coin track insert 41 and illuminating the edges of the coins 14 as they pass by (the coins themselves block the optical waves from passing through). A krypton lamp can be inserted among the LED's to provide suitable light waves in the infrared range of frequencies. The optical waves generated by the light source may be in the visible spectrum or outside the visible spectrum, such as in the infrared spectrum. In any event, the terms "light" and "optical waves" shall be understood to cover both visible and invisible optical waves.

The housing shroud 50 is supported by an upright post member 51 of rectangular cross section. The post member 51 is positioned just outside the coin track 23, so as to allow the optical source to extend across the coin sorting path 23 and to be positioned directly above the window 49.

Figure 2:
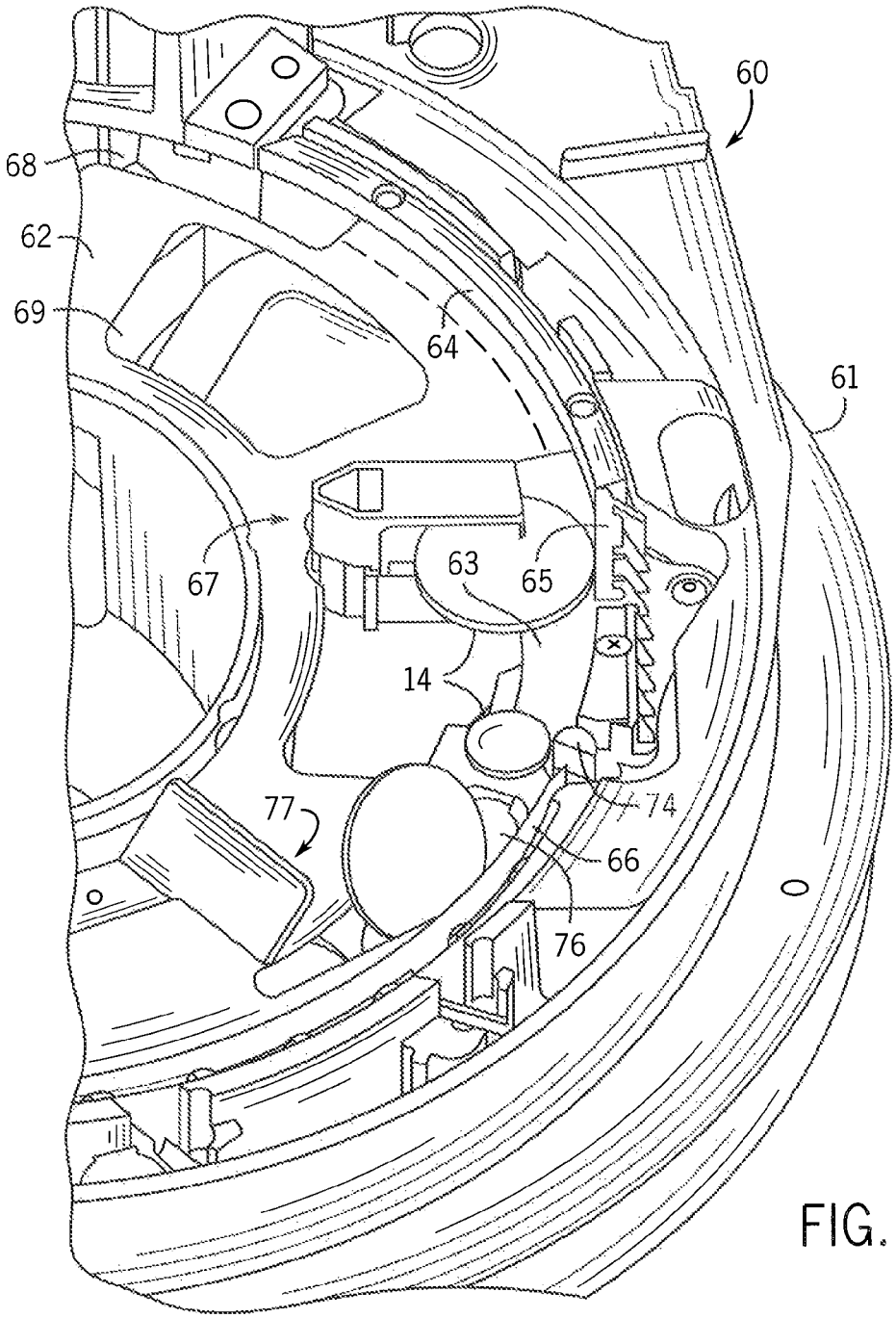
FIG. 2 is a fragmentary perspective view of the apparatus of the present invention with parts removed, according to an exemplary embodiment.

Referring now to FIG. 2, an alternative coin handling machine 60 has a dual disk architecture similar to that described above, but may be configured to include a second coin sensing configuration. The machine 60 may be provided in two embodiments, one with sorting openings like the openings 15-20, described above with reference to FIG. 1 and another with only a single coin collection opening similar to the largest sorting opening 20, also shown in FIG. 1. Coins of all denominations are collected through this opening after passing a coin sensor assembly 67 and an offsorting slot 76. In the embodiment in which the coin sensor assembly 67 senses the identity of the coin, the sensors, optical sensors and optical detectors at each opening are not required, with a resulting savings in cost. In single-opening embodiment, the coins are directed to coin bins of a type in which one bin is filled with mixed denominations and then a second bin is filled with mixed denominations that have been counted and valued using the coin sensor assembly 67 of the present invention to identify each coin.

The second coin sensing configuration is also applicable to an embodiment having coin sorting openings 15-20, either with or without coin detectors at the openings 15-20. In either embodiment, the plane of the sorting plate 62, and thus, the coin track 63, can either be horizontal or angled from horizontal by an amount no greater than thirty degrees, and this shall encompassed by the term "substantially horizontal" in relation to the coin track 63.

Figure 5:
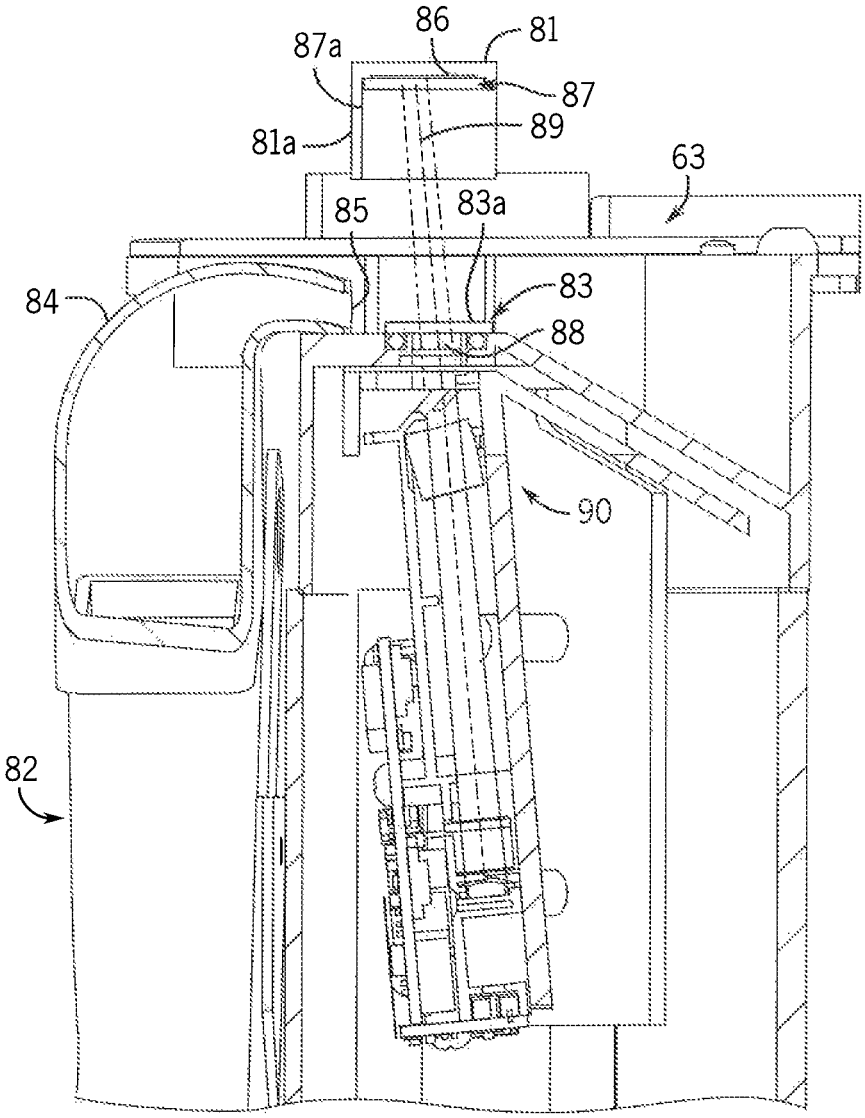
FIG. 5 is a side view of a coin sensor assembly, according to an exemplary embodiment.

The coin sensor assembly 67 can detect a size of an individual coin 14 in a plurality of coins being moved within a coin handling machine 60 and can also detect and offsort invalid coins moving through the coin handling machine 60. Coin sensor assembly may be configured to detect at least five coin attributes including coin diameter using an optical sensor, coin alloy-core, coin alloy-surface, and coin thickness using an inductive sensor, and coin magnetism using a hall sensor. The coin handling machine 60 has a base member 61 for supporting a sorting plate 62 having a coin track 63 passing along an outside reference edge 64, 65, 66 for the coins that is formed by base member arcuate portion 64, an edge sensor assembly 65 and an upstanding rail 66. Although coin track 63 is shown and described as having an arcuate outside reference edge 64, it should be understood that variations, such as a linear reference edge and a straight drive may be used in the alternative. Some additional offsorting slots 68, 69 and 70 have been provided for coins not in position along the reference edge. A coin sensor assembly 67 now includes a reflective-type optical sensor and is positioned to the inside of a coin track 63, ahead of the coin sorting slots (not seen in FIG. 2). The light source is now positioned lower than the coin track 63 rather than above it for illuminating at least portions of the coins as the coins move along the coin track 63. As seen in FIG. 5, the shroud portion 81 of the coin sensor assembly 67 has a reflector 86, 87 on its underside positioned above the coin track 63. An optical detector is located on a circuit board 95 (FIGS. 6 and 7) that is positioned below the cover 83 for the sensor 90 for detecting a size of at least a portion of each coin 14 passing the coin sensor 67 along the coin track 63. A telecentric lens 94 (FIG. 6) is positioned between the optical detector circuit board 95 and the coin track 63, such that the portion of each coin passing the optical detector circuit board 95 is seen to have an apparent size and configuration independent of a variation in distance of the coin from the telecentric lens as each coin moves along the coin track.

Figure 4:
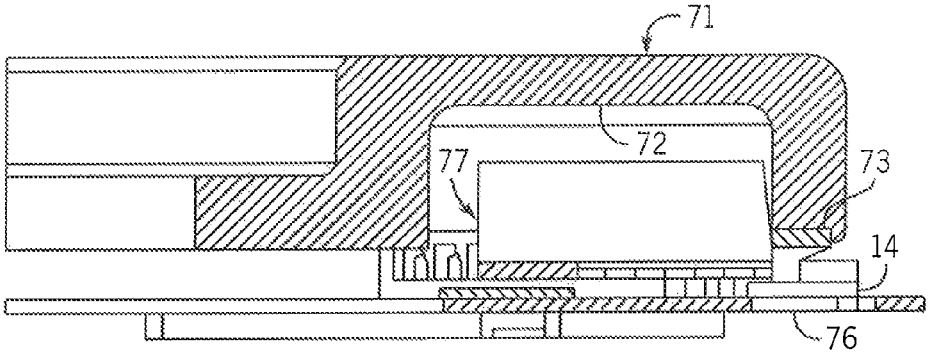
FIG. 4 is a detail sectional view of a portion of the apparatus seen in FIG. 3, according to an exemplary embodiment.

In an alternative embodiment, the reflector 86, 87 can be provided by a reflective strip of material in cavity 72, seen in FIG. 4. A brush can be installed along the path of rotation of the disk 71 to brush dust off the reflective portion of the disk 71.

Figure 13:
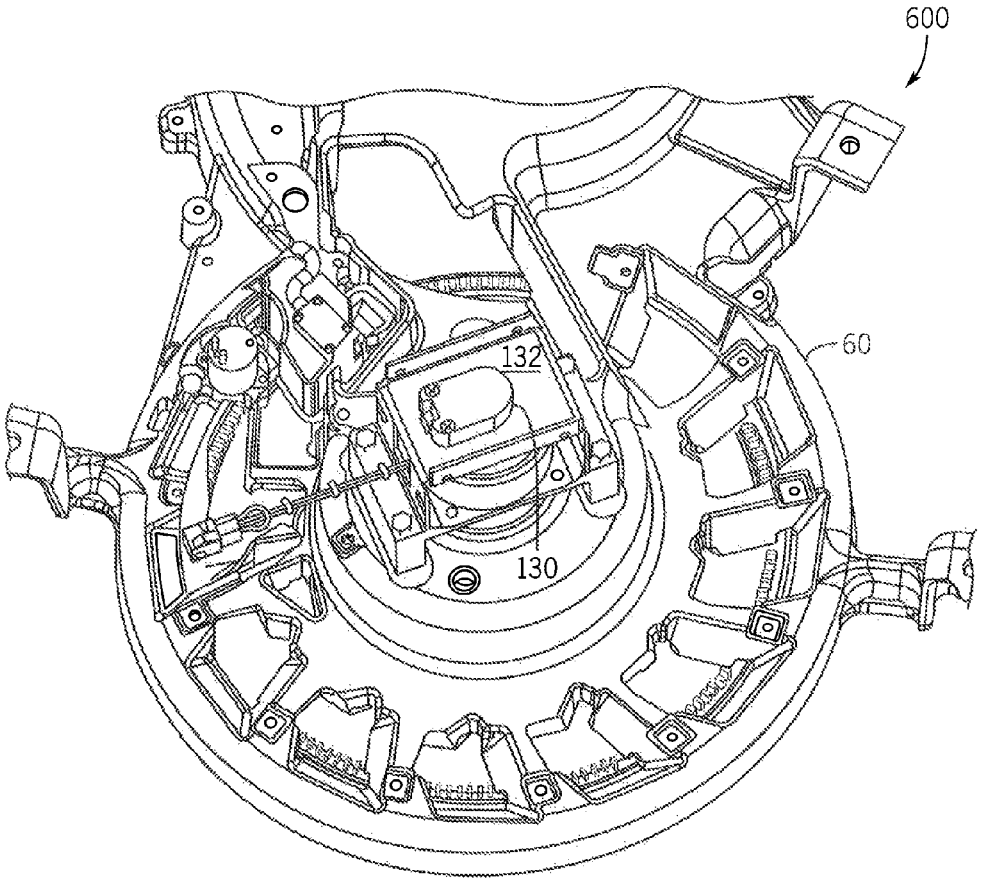
FIG. 13 is a bottom plan detail view of the coin offsorting mechanism of the coin sorter of FIG. 3 illustrating an exemplary positioning of an encoder, according to an exemplary embodiment.

Machine 60 may be configured to monitor an angular position of each coin being moved by the coin moving member 21 using an encoder 130 (see FIG. 13). Machine 60 may monitor the angular position by directly monitoring the member 21 and/or by monitoring a drive sheave (also not shown) applying a rotational output to the coin moving member 21. The encoder 130 may be configured to utilize a drive wheel driven by the drive sheave to determine the angular position.

Figure 3:
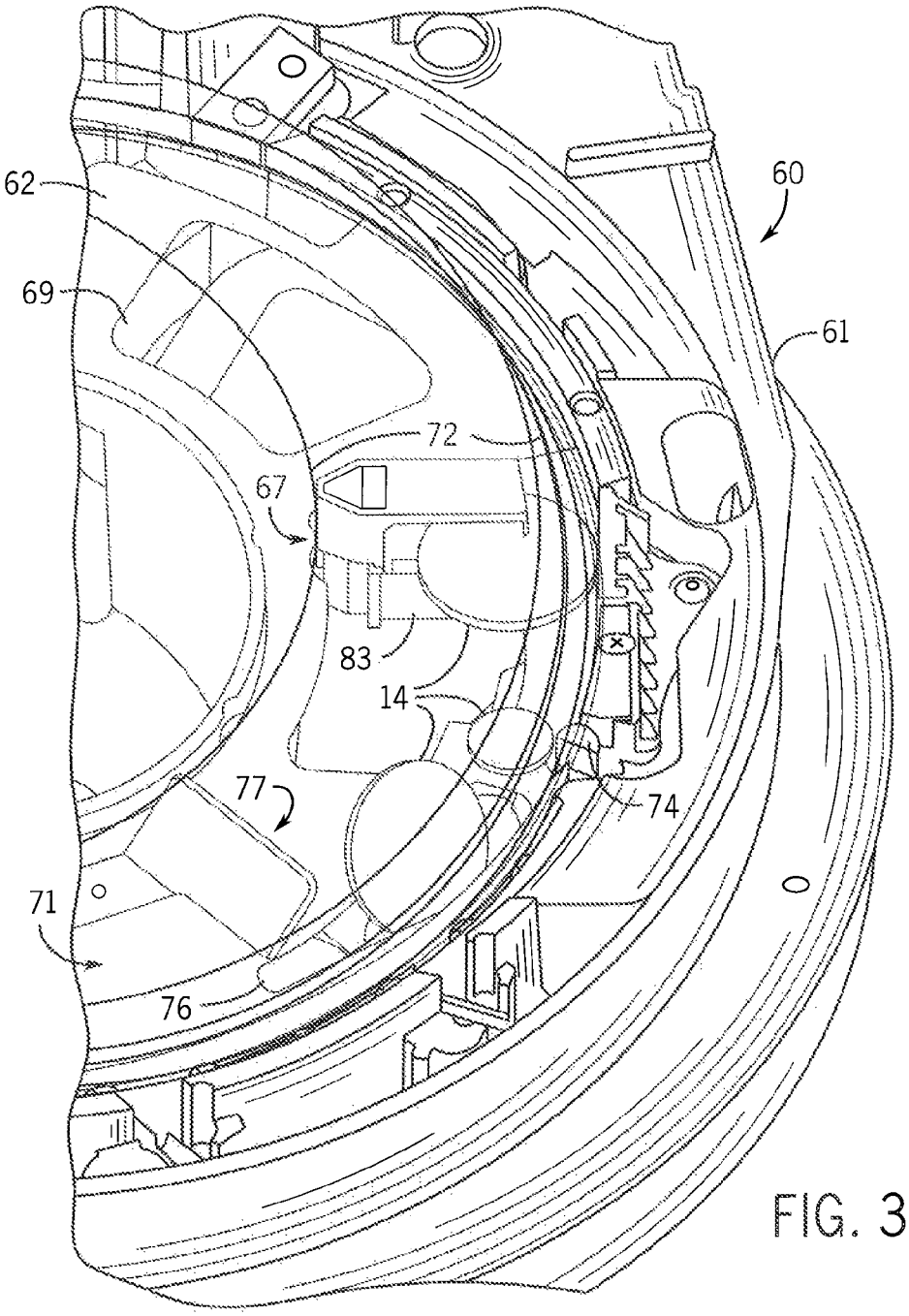
FIG. 3 is a fragmentary perspective view of the apparatus of the present invention with parts made transparent, according to an exemplary embodiment.

The feeding disk 11, in conjunction with features of the sorting assembly, feed the coins onto the coin track 63 in a single layer and in a single file in a manner known in the prior art. FIG. 3 shows that the coin moving disk 71 has been modified to provide a recess 72 (see also FIG. 4) for allowing the coin moving disk 71 to pass over the top of the coin sensor assembly 67 and to pass by the coin sensor assembly 67 on opposite sides. The coin moving disk 71 is shown as transparent for illustration purposes only, and in practice can be transparent, semi-opaque or opaque as there is no longer a requirement to shine a light source through the coin moving member 71. The fins or fingers 73 (see also FIG. 4) of the coin moving disk 71 have been made much narrower than in the prior art and now press down on the outside portions of the coins 14 near the reference edge.

This has the effect of tipping up the inside edges of the coins 14 off the coin track 63, as seen in FIGS. 2 and 3, so that the coins are cantilevered over the inside edge of the coin track 63. The coin moving disk 71 is operable to move the coins along in single file at a rate up to 6000 coins per minute.

The machine 60 has an offsorting arrangement including an offsorting slot 76, a deflector 77 and a solenoid-driven coin diverter 74, all of which are more fully described in a U.S. Pat. No. 7,704,133, the disclosure of which is hereby incorporated by reference. This is for offsorting coins that are detected as invalid by the coin sensor assembly 67.

Figure 6:
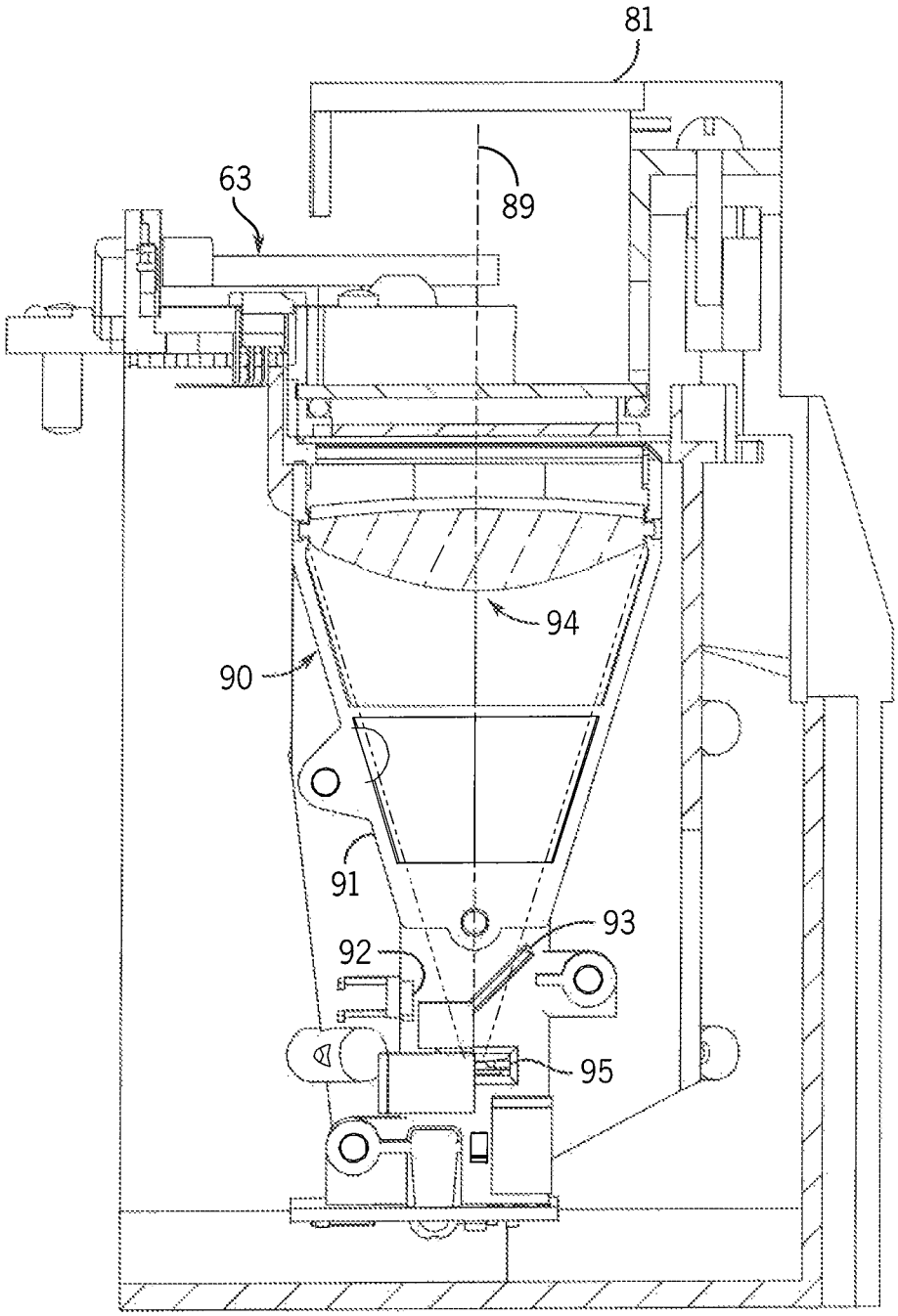
FIG. 6 is a front view of the coin sensor assembly of FIG. 5, according to an exemplary embodiment.
Figure 7:
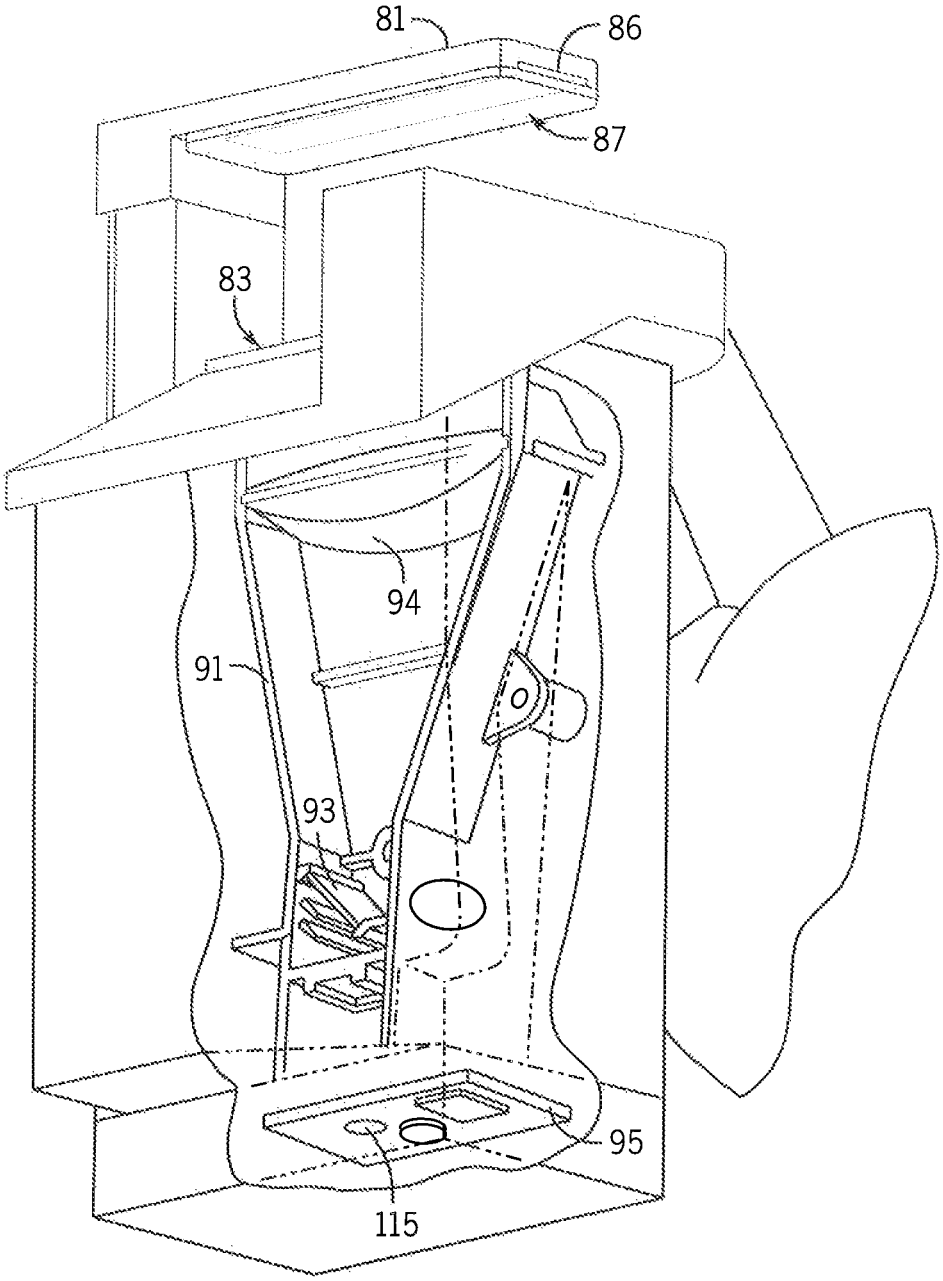
FIG. 7 is a perspective view of the coin sensor assembly of FIG. 5, according to an exemplary embodiment.

The details of the optical sensor and detector assembly 90 are illustrated in FIGS. 5, 6 and 7. The telecentric lens 94 is mounted in a framework 91. A source 92 of LED illumination is mounted in the framework 91 to direct illumination to a reflective and refractive element 93 that will reflect light upwardly along axis 89 and through slot 88 and transparent member 83 seen in FIG. 5. From there, it will travel to the reflector 86, 87 unless blocked by a portion of a coin 14. After reflection, the light will travel back along the axis 89 to reflective and refractive element 93, but this time the light will pass through the element 93 rather than being reflected, and it will travel to the detector on the circuit board 95.

As seen in FIGS. 5 and 6, the telecentric lens 94 can be disposed on an axis 89 that is at an angle in a range from two degrees to thirty degrees from vertical, so as to block reflections from the cantilevered portions of the coins 14. The telecentric lens 94 in FIGS. 5 and 6 is more actually disposed on an axis that is at an angle of five degrees from vertical.

Figure 8:
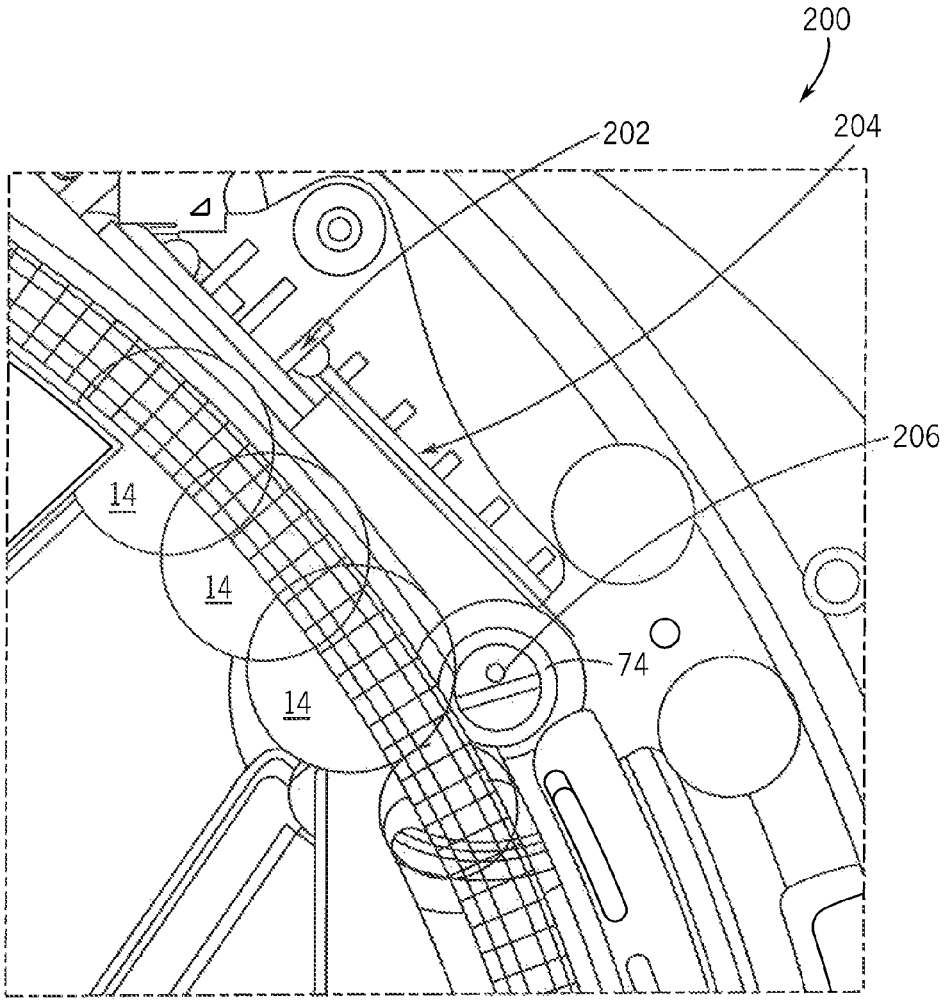
FIG. 8 is a top plan detail view of the coin offsorting mechanism of the coin sorter of FIG. 2, according to an exemplary embodiment.

Referring now to FIG. 8, a top plan detail view 200 of the coin offsorting mechanism of the coin sorter 10 is shown. Reject solenoid 74 is shown to be positioned a distance from the coin sensor station 41. Based on the distance, and depending on the speed of the coin sorter 10, the reject solenoid 74 may be utilized to influence the trajectory of coin that has been analyzed by sensor station 41. Coin sorter 10 may be configured to utilize the encoder to calculate the speed of the coin moving member 21 and utilize the calculated speed and the size of the coin, selectively operate solenoid 74 to alter the trajectory of the coin. For example, where coin sorter 10 determines that a coin should be offsorted, coin sorter 10 may be configured to operate the solenoid 74 to divert the coin to offsorting slot 76. Using the information from the encoder, control of the solenoid 74 may be performed based on a known position and size of the coin.

View 200 illustrates a coin 14 in a first position 202 exiting the sensor station 41. As the coin is exiting, a coin discriminator/offsort controller module 110, described in further detail below with reference to FIG. 6, makes a determination whether to accept or rejection the coin. As the coin 14 moves along the coin sorting path 23 to a second position 204, coin discriminator/offsort controller module 110 determines that the coin has reached position 204 based on encoder data and transmits a signal to actuate the solenoid 74. According to an exemplary embodiment, position 204 is a variable position that is determined based on the size of the coin 14 and the coin travel speed as determined based on the data from the encoder.

The distance between the second position 204 and a third position 206 may be configured based on the time required for solenoid 74 to complete actuation based on a received signal from the coin discriminator/offsort controller module 110. Accordingly, the distance between second position 204 and third position 206 may be configured based on a number of factors including the size of the coin 14, the travel speed of the coin 14 as calculated based on encoder data, the operating characteristics of the solenoid 74, the signal delay between the coin discriminator/offsort controller module 110 and the solenoid 74, etc. For example, encoder 130 may be configured to provide encoder count. The encoder count, in combination with sensed attributes of the coin 14, may be used to control operation of the solenoid 74. The encoder count may be used to represent the distance that a coin 14 has to travel before being operated on by the sorter 10.

According to an exemplary embodiment, the encoder count is used by controller module 110 to calculate the speed of the coin moving member to determine an exact position of each coin being conveyed by the coin moving member past the sensor assembly 67. This exact positioning is used to actuate the solenoid 74 such that the solenoid 74 is actuated at any time between when an accepted coin 14 has passed the solenoid 74 and the time that the position of a coin 14 to be rejected matches the positioning of the solenoid. The reject solenoid remains in the actuated position for a number of encoder pulses based on the speed of the coin moving member. After the coin has been rejected, the solenoid 74 deactuates. The position of the coin 14 may be determined based on the equation:

$$\text{Position}=(\text{ENCODER}_{MAX}-(\text{ENCODER}_{MULT}(\text{coin diameter})))/10000$$

where $\text{ENCODER}_{MAX}$ is the maximum number of encoder pulses based on the size of the coin moving member, $\text{ENCODER}_{MULT}$ is a multiplier determined based on signal lag (~8 msec in one embodiment) and the coin diameter is sensed by the sensor assembly 67.

Advantageously, the coin position determination based on the size of the sensed coin gives a more exact determination of the coins position and its interaction with the components of the coin sorter 10 such as the solenoid 74, the offsort opening(s) and the coin counting openings, such as openings 15-20. This more exact determination reduces the likelihood to improper coin offsorting. For example, when the solenoid 74 is fired only after the diameter of an accepted coin has passed but before a rejected coin has reached the offsort position, it cannot improperly offsort the accepted coin. The coin position determination may further be used to count the coin into a receptacle to improve accuracy over the aperture sensors described above with reference to FIG. 1.

Further, the coin position determination may be used for multiple reject locations without requiring exact positioning of the solenoid 74 based on speed of the coin moving member. Specifically, the distance between the solenoid 74 and the sensing assembly 67 can vary using modification to the equation listed above. Further, coin positioning specific offsorting allows counts of a second type of offsorted coins, such as counterfeit coins to be stored in a locked escrow box affixed to the coin sorter 10, by offsorting these coin at a specific location of the coin sorting path 23.

Yet further, coin offsorting based on exact positioning and coin size increases the accuracy of the coin sorting, preventing improperly offsorted coins. Improperly offsorted coins can interfere with proper coin counts. When coins are improperly offsorted, the offsorted coins require resorting which typically includes operator intervention and additional processing time.

Figure 9:
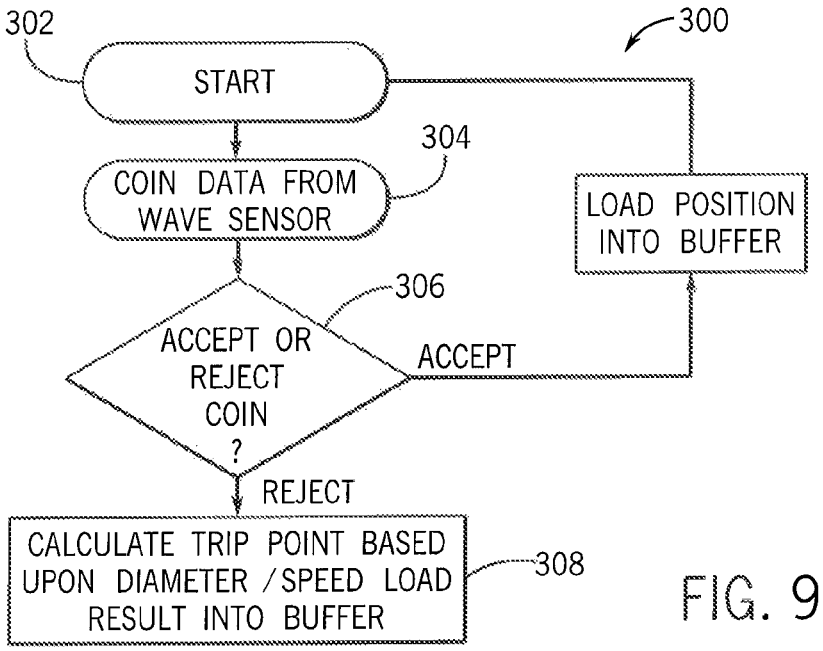
FIG. 9 is a flow diagram illustrating the flow of data in the coin discriminator/offsort controller module of FIG. 12 at the time of acceptance or rejection of a coin, according to an exemplary embodiment.

Referring now to FIG. 9, a flow diagram 300 illustrating the flow of data in the coin discriminator/offsort controller module 110 at the time of acceptance or rejection of a coin 14 starting with a step 302 is shown. In a sensing step 304, coin 14 data is received from coin sensor station 41. Upon receipt of the data, coin discriminator/offsort controller module 110 is configured to accept or reject the coin, as represented by decision block 306. The decision to accept or reject a coin may be based on a plurality of sensed coin attributes as described above with reference to coin sensor assembly 67. If the coin is to be rejected, a trip point is calculated based on at least coin diameter and speed and the coin position calculation calculated by controller module 110 and the result is loaded into a buffer in a step 308. If the coin in to be accepted, the coin position calculated by controller module 110 is loaded into a buffer in a step 310.

According to an alternative embodiment, coin discriminator/offsort controller module 110 may be configured to utilize set trip values based on coin size. For example, controller module 110 may be configured to utilize the coin size data received in block 304 to determine whether the coin is a small coin, having a diameter less than 50 mm, is a medium coin, having a diameter between 50 mm and 95 mm, or a large coin, having a diameter greater than 95 mm. Where the coin is determined to be a small coin, coin discriminator/offsort controller module 110 is configured to load a set a trip point value equal to 95. Where the coin is determined to be a medium coin, coin discriminator/offsort controller module 110 is configured to load a set a trip point value equal to 50. Where the coin is determined to be a large coin, coin discriminator/offsort controller module 110 is configured to load a set a trip point value equal to 20. Coin discriminator/offsort controller module 110 may then be configured to load an accept or reject state into a coin position buffer associated with the specific coin, similar to blocks 308 and 310 as described above.

Figure 10:
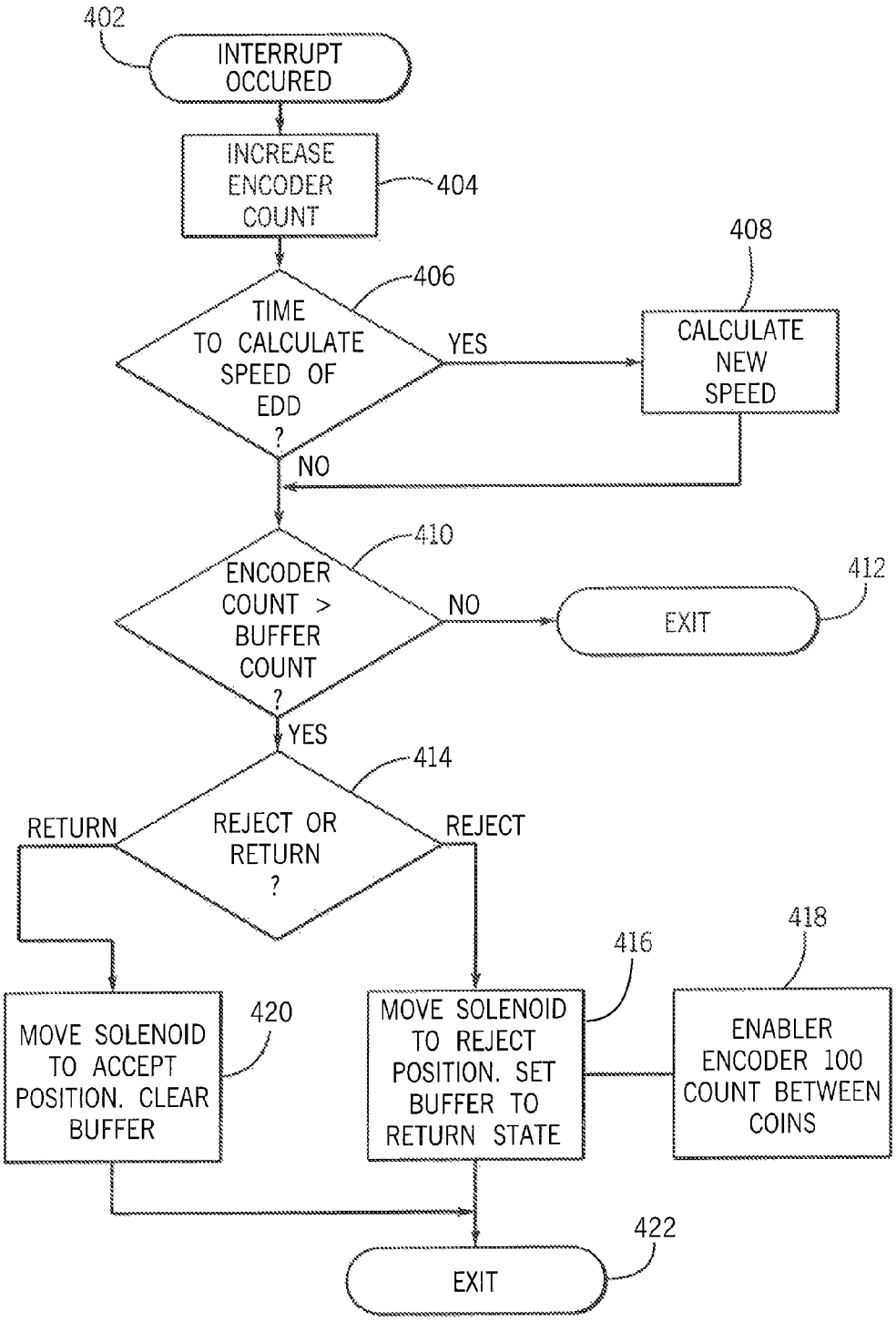
FIG. 10 is a flow diagram illustrating the function of coin discriminator/offsort controller module of FIG. 12 is controlling the operation of a solenoid based on an interrupt received from an encoder, according to an exemplary embodiment.

Referring to FIG. 10, a flow diagram 400 illustrating the function of coin discriminator/offsort controller module 110 is controlling the operation of the solenoid 74 based on an interrupt received from the encoder. In a start block 402, an interrupt is received by coin discriminator/offsort controller module 110. The interrupt may be received based on detection of a change in angular position of the coin moving member 21. In response, coin discriminator/offsort controller module 110 is configured to increase the encoder count, as depicted by block 404. Following the increase in the encoder count, controller module 110 determines whether a timer has expired indicating a need to calculate the speed of the coin moving member 21 in a step 406. If yes, the speed is determined based on an output from encoder 130 in a step 408.

If the coin discriminator/offsort controller module 110 determines that the encoder count is not greater than the buffer count, as depicted by decision block 410, the controller exits and awaits the next encoder interrupt, as depicted by exit block 412. If the coin discriminator/offsort controller module 110 determines that the encoder count is greater than the buffer count, as depicted by block 414, the controller transmits a signal to solenoid 74 to be in a reject state based on the buffer state, as depicted by block 416, and enables an encoder 100 count delay between coins, as indicated by block 418. Else, the controller transmits a signal to solenoid 74 to be in an accept state based on the buffer state, as depicted by block 420. Following the delay enablement, coin discriminator/offsort controller module 110 exits and awaits the next encoder interrupt, as depicted by exit block 422.

Referring again to FIG. 8, where coin discriminator/offsort controller module 110 accepts a coin 14, coin discriminator/offsort controller module 110 may further be configured to determine, based on the data from the coin sorting station 41, the number of encoder pulses that will be required for the coin 14 to complete travel along the coin sorting path 23 to the appropriate sorting opening 15-20, such that the coin 14 should be in the correct bag. Coin discriminator/offsort controller module 110 may be configured to include coin position buffers for each sorting opening 15-20 to allow position monitoring for multiple coins on coin sorting path 23 at the same time.

Figure 11:
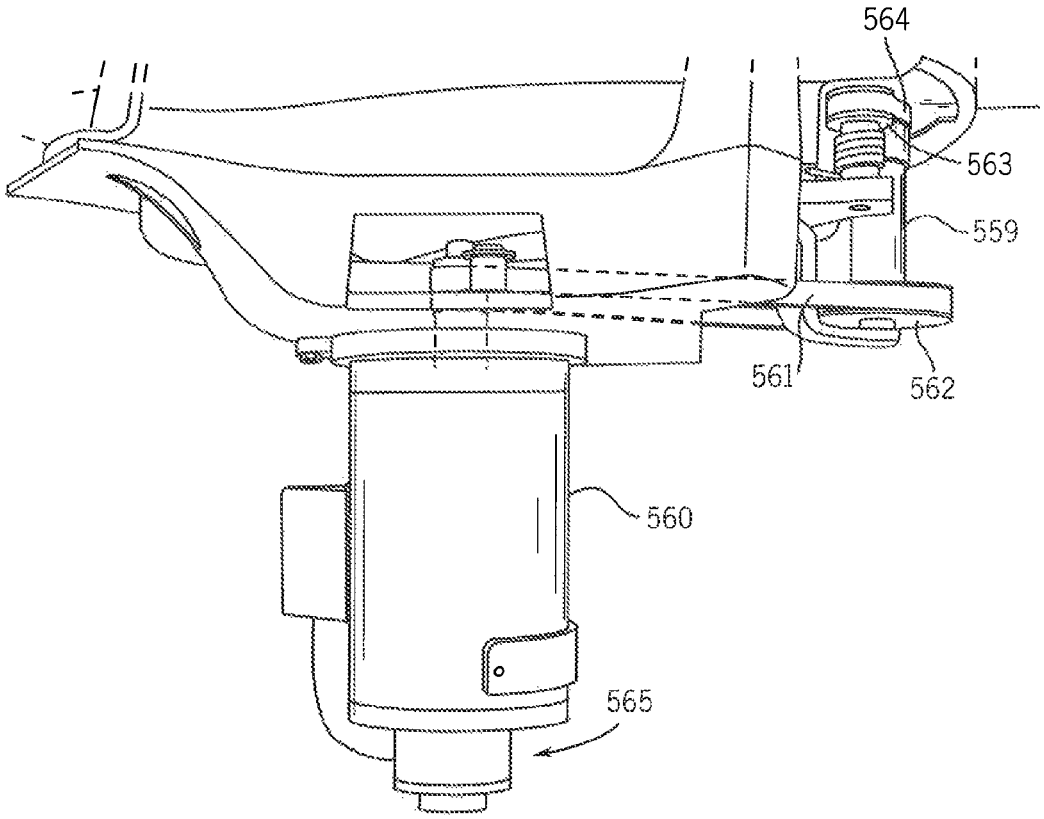
FIG. 11 is a perspective view of a DC electric motor for driving the two moving disks in the coin sorter of FIG. 3, according to an exemplary embodiment.

FIG. 11 shows a DC electric motor 560 for driving the two moving disks in the coin sorter 10. The motor 560 is connected through a belt 561 to a rotatable transfer shaft 559 with one pulley 562 being driven by belt 561 and a second pulley 563 for transferring power to a second belt 564 directly driving coin moving member 21 and the driving member 11 in the queuing portion of the machine 10. An electromechanical brake 565 is mounted to the shaft of the drive disk. The brake 565 is used for stops when a predetermined coin count has been reached and for emergency stops. The data from the optical imaging sensor is used for purposes of counting coins to reach the predetermined coin counts, known as bag stop limits.

Figure 12:
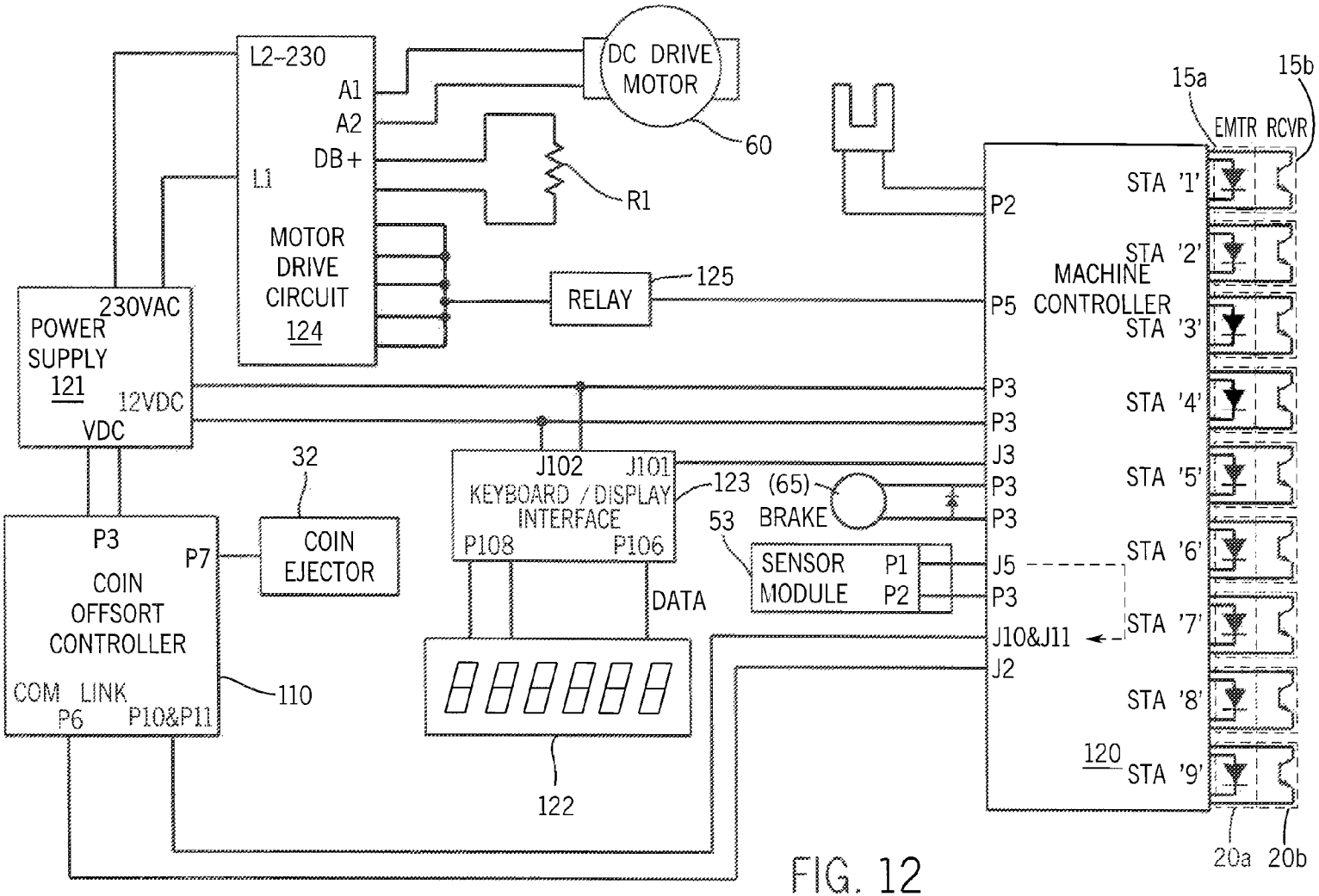
FIG. 12 is representation of a machine controller for controlling, the coin sorting mechanism, according to an exemplary embodiment.

Referring to FIG. 12, the machine controller CPU 120 has nine I/O ports (STA 1-STA 9) for sending output signals to the light emitting diodes and receiving signals from the optical detectors for the six sorting openings 15-20. The main controller CPU 120 thereby detects when coins fall through each sorting opening 15-20 and can maintain a count of these coins for totalizing purposes. By "totalizing" is meant the counting of coin quantities and monetary value for purposes of informing a user through a display, such as a graphic, liquid crystal display (LCD) 122, which is interfaced with a keyboard through interface 123 to the main controller CPU 120.

The main controller CPU 120 is interfaced through electronic circuits to control the DC drive motor 60. In particular, the main controller CPU 120 is connected to operate a relay 125 which provides an input to an electronic motor drive circuit 124. This circuit 124 is of a type known in the art for providing power electronics for controlling the DC motor 60. This circuit 124 receives AC line power from a power supply circuit 121. The motor drive circuit 124 is also connected to a dynamic braking resistor R1 to provide dynamic electrical braking for the DC motor 60.

The coin discriminator/offsort controller module 110 includes a processor, as well as the typical read only memory, RAM memory, address decoding circuitry and communication interface circuitry to communicate with the sensor control module 53 and the main controller CPU 120 as shown in FIG. 7. The coin discriminator/offsort controller module 110 is connected to operate the coin ejector mechanism 32, when a coin is determined to be outside all of the coin specifications based on data received from the coin sensing station 41.

Referring now to FIG. 13, a bottom plan detail view 600 of the coin offsorting mechanism of the coin sorter 10, illustrating an exemplary positioning of an encoder 130 is shown. Encoder 130 may be mounted to an encoder mounting bracket 132 and configured to receive a terminal end of the rotatable transfer shaft 559 (FIG. 11). Encoder 130 may be an electromechanical device that converts the angular position or motion of shaft 559 to an analog or digital signal. The output of encoder 130 provides information about the motion of shaft 559 to processor 120 that may be converted into information such as speed, distance, RPM, position, etc. This information may in turn be used, for example, by coin discriminator/offsort controller module 110 to operate the solenoid 74.

This has been a description of preferred embodiments of the invention. Those of ordinary skill in the art will recognize that modifications might be made while still coming within the scope and spirit of the present invention as will become apparent from the appended claims. For example, although the embodiment above are provide with reference to a FIG. 8 coin sorter, the method and apparatus described herein may be used with any friction drive coin sorter. Various other embodiments of the invention are contemplated as being within the scope of the following claims particularly pointing out and distinctly claiming the subject matter regarded as the invention.

We claim:

1. A coin handling machine having a queuing mechanism for feeding coins to a sorting mechanism, the coin handling machine comprising:

a reference edge disposed along a sorting disk for coins moving along a coin sorting path, the sorting disk having at least one opening for receiving valid coins as the coins travel along the coin sorting path;

a drive member for control of coins as the coins are moved in a single layer and a single file along the reference edge;

a diverter disposed along the reference edge, the diverter member being operable to project into the coin sorting path in advance of sorting openings to move a coin selected for offsorting away from the reference edge;

an offsort opening in the sorting path, the offsort opening being located between the diverter member and the at least one opening for receiving valid coins, spaced from the reference edge, and positioned in the coin sorting path to receive coins that have been moved laterally toward the offsort opening;

a coin sensor station configured to sense at least a coin size attribute of each coin;

an encoder providing an encoder count based on the rotation of the drive member; and a coin discriminator/offsort controller module receiving the coin size attribute and controlling the operation of the diverter based on at least the encoder count and the coin size attribute independent of the type of coin, wherein controlling the operation of the diverter includes adjusting the timing of the operation based on coin size.

2. The coin handling machine according to claim 1, wherein the encoder count and coin size attribute are used to determine a position of every coin on the coin sorting path after the coin sensor station.

3. The coin handling machine according to claim 2, wherein the position determination includes a position determination of both leading and trailing edges of the coin.

4. The coin handling machine according to claim 2, wherein the position determination is used to calculate an interaction time for a coin and the diverter.

5. The coin handling machine according to claim 4, wherein the interaction time for a coin and the diverter is calculated based at least in part on the coin size attribute.

6. The coin handling machine according to claim 2, wherein the position determination is used to calculate an interaction time for a coin and at least one of the offsort opening and the sorting openings.

7. The coin handling machine according to claim 6, further including counting a coin at the time of interaction of the coin and one of the offsort opening and the sorting openings based on the position determination.

8. A method of counting coins in a coin sorter before reaching an opening to at least one collection receptacle, the method comprising:

driving a plurality coins along their outer edges against a coin track that is adjacent a reference edge with the coins extending outwardly over an inside edge of the coin track;

calculating a coin travel speed along the coin track based on an encoder counter using a controller module receiving data from an encoder;

sensing at least a coin size attribute of the coin at a sensor assembly on the coin track;

transmitting the coin size to a coin discriminator/offsort controller module controlling the operation of a diverter based on at least the encoder count and the coin size attribute independent of the type of coin; and counting the coin based on an interaction between the coin and one of a coin offsorting opening and a coin sorting opening based on the coin travel speed and the coin size attribute, wherein the interaction between the coin and one of a coin offsorting opening and a coin sorting opening is determined based on coin size.

9. The method of claim 8, wherein the coin travel speed and the coin size attribute are used to determine a position of every coin on the coin sorting path after the sensor assembly.

10. The method of claim 9, wherein the position determination includes a position determination of both leading and trailing edges of the coin.

11. The method of claim 10, wherein the position determination is used to calculate an interaction time for the coin and a diverter prior to counting the coin at the offsort opening.

12. The method of claim 11, wherein the interaction time for the coin and the diverter is calculated based at least in part on the coin size attribute.

13. The method of claim 9, wherein coins are fed through the coin sorter at a rate up to 6000 coins per minute.

14. A coin handling machine having a queuing mechanism for feeding coins to a sorting mechanism, the coin handling machine comprising:

a reference edge disposed along a sorting disk for coins moving along a coin sorting path, the sorting disk having at least one opening for receiving valid coins as the coins travel along the coin sorting path;

a drive member for control of coins as the coins are moved in a single layer and a single file along the reference edge;

a diverter disposed along the reference edge, the diverter member being operable to project into the coin sorting path in advance of the sorting openings to move a coin selected for offsorting away from the reference edge; and an offsort opening proximate to the sorting path, the offsort opening being located between the diverter member and the at least one opening for receiving valid coins, spaced from the reference edge, and positioned in the coin sorting path to receive coins that have been moved laterally toward the offsort opening;

a coin sensor station positioned above the coin sorting path and having at least an optical sensor for identifying a coin size attribute for each coin in the coin sorting path;

an encoder providing an encoder count based on the rotation of the drive member, a coin discriminator/offsort controller module receiving the coin size attribute and controlling the operation of the diverter based on at least a lag time associated with the diverter, the encoder count and the coin size attribute independent of the type of coin, wherein controlling the operation of the diverter includes adjusting the lag time of the operation based on coin size.

15. The coin handling machine according to claim 14, wherein the encoder count and coin size attribute are used to determine a position of every coin on the coin sorting path after the coin sensor station.

16. The coin handling machine according to claim 15, wherein the position determination includes a position determination of both leading and trailing edges of the coin.

17. The coin handling machine according to claim 15, wherein the position determination is used to calculate an interaction time for a coin and the diverter.

18. The coin handling machine according to claim 17, wherein the interaction time for a coin and the diverter is calculated based at least in part on the coin size attribute.

19. The coin handling machine according to claim 15, wherein the position determination is used to calculate an interaction time for a coin and at least one of the offsort opening and the sorting openings.

20. The coin handling machine according to claim 19, further including counting a coin at the time of interaction of the coin and one of the offsort opening and the sorting openings based on the position determination.

* * * * *